United States Patent [19]

Leatham et al.

[11] Patent Number: 4,804,034

[45] Date of Patent: Feb. 14, 1989

[54] METHOD OF MANUFACTURE OF A THIXOTROPIC DEPOSIT

[75] Inventors: Alan Leatham, Swansea; Andrew Ogilvy, Neath, both of Wales

[73] Assignee: Osprey Metals Limited, Neath, Wales

[21] Appl. No.: 139,105

[22] Filed: Dec. 24, 1987

Related U.S. Application Data

[63] Continuation of Ser. No. 842,941, Mar. 24, 1986, abandoned.

[30] Foreign Application Priority Data

Mar. 25, 1985 [GB] United Kingdom ..... 8507646
Nov. 12, 1985 [GB] United Kingdom ..... 8527859

[51] Int. Cl.[4] ..... B22D 25/06; B22D 27/09

[52] U.S. Cl. ..... 164/46; 164/122; 164/900; 118/320

[58] Field of Search ..... 164/900, 46, 66.1, 133, 164/136, 97, 122; 118/320, 321

[56] References Cited

U.S. PATENT DOCUMENTS

| | | | |
|---|---|---|---|
| 3,826,301 | 7/1974 | Brooks | 164/46 |
| 3,909,921 | 10/1975 | Brooks | 164/46 |
| 4,114,251 | 9/1978 | Southern et al. | 164/46 |
| 4,420,031 | 12/1983 | Frykendahl | 164/473 |
| 4,486,470 | 12/1984 | Stuck et al. | 427/196 |
| 4,512,384 | 4/1985 | Sendzimir | 164/46 |
| 4,592,404 | 6/1986 | Sendzimir | 164/46 |
| 4,674,554 | 6/1987 | Feest | 164/97 |

FOREIGN PATENT DOCUMENTS

| | | | |
|---|---|---|---|
| 127303 | 12/1984 | European Pat. Off. | 164/46 |
| 198613 | 10/1986 | European Pat. Off. | 164/46 |
| 86969 | 5/1983 | Japan | 164/46 |
| 218359 | 12/1983 | Japan | 164/900 |
| 399297 | 2/1974 | U.S.S.R. | 164/46 |
| 809412 | 2/1959 | United Kingdom | 164/46 |
| 1262471 | 2/1972 | United Kingdom | 164/46 |
| 1431895 | 4/1976 | United Kingdom | 164/46 |
| 1455862 | 11/1976 | United Kingdom | 164/46 |
| 1565363 | 4/1980 | United Kingdom | 164/900 |
| 1574711 | 9/1980 | United Kingdom | 164/46 |
| 2115014 | 9/1983 | United Kingdom | 164/97 |
| 2153392 | 8/1985 | United Kingdom | 164/46 |
| 2155376 | 9/1985 | United Kingdom | 164/46 |
| 8203809 | 11/1982 | World Int. Prop. O. | 164/46 |

*Primary Examiner*—Nicholas P. Godici
*Assistant Examiner*—Samuel M. Heinrich
*Attorney, Agent, or Firm*—Roylance, Abrams, Berdo & Goodman

[57] ABSTRACT

A method of casting is provided in which a rheocast deposit is formed by atomizing a stream of molten metal or metal alloy by subjecting the stream of molten metal or metal alloy to relatively cold gas directed at the stream, and directing the resultant spray of metal droplets at a collector. The deposit is provided with a rheocast type structure by extracting heat from the metal droplets such that the material deposited at the collector includes solid phase particles in a liquid phase which, upon solidification, forms a microstructure characterized by a fine network of microsegregate at the grain boundaries or coring across the grains and which, above the solidus region of the said metal or metal alloy, exhibits thixotropic properties. The rheocast deposit may be thixotropically deformed either during or after deposition.

13 Claims, 10 Drawing Sheets

SPRAY RHEOCAST Al – Si ▲

SPRAY RHEOCAST M2 H.S.S. ■

STIR RHEOCAST Al – Si ○

CHILL CAST Al – Si ▽

100 μ

100 μ

100μ

100μ

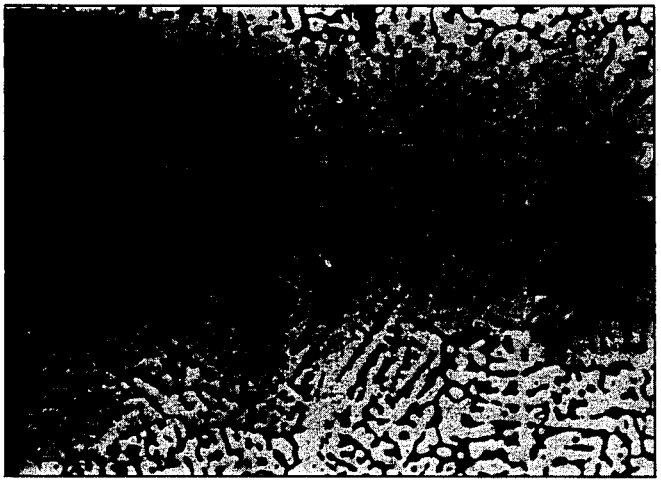
FIG. 9. 100 μ
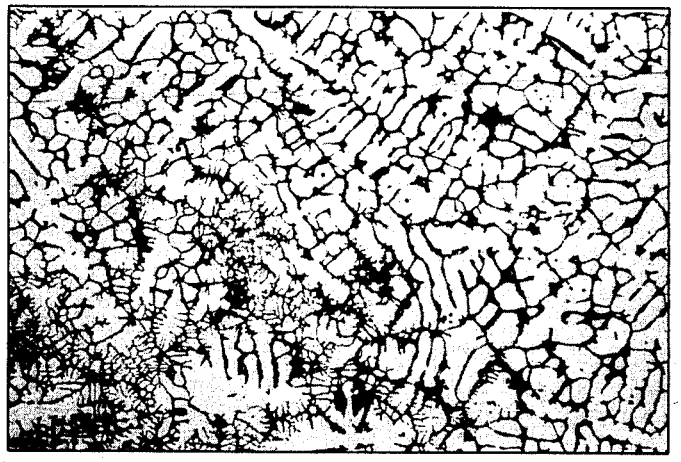
FIG. 10. 100 μ

1 X

1 X

100 μ

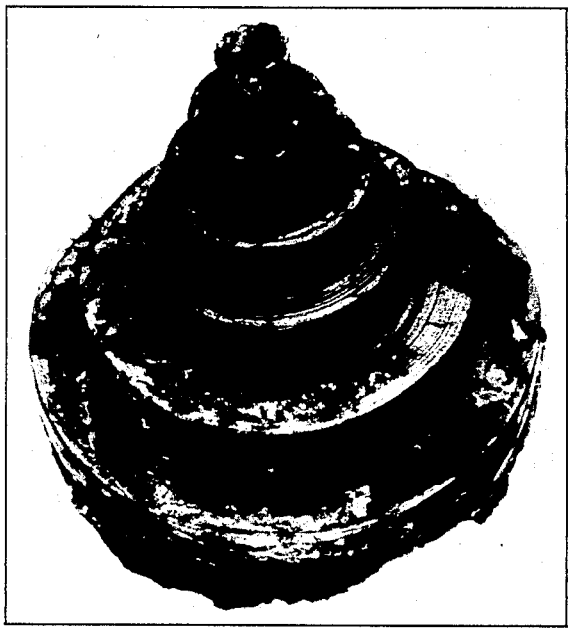
FIG. 15. 10mm
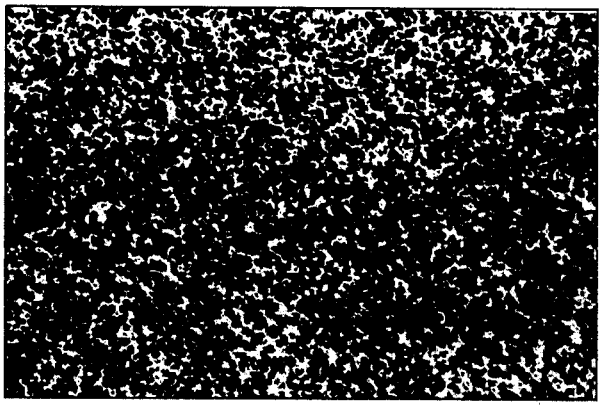
FIG.16. 100μ

METHOD OF MANUFACTURE OF A THIXOTROPIC DEPOSIT

This is a continuation of application Ser. No. 842,941 filed Mar. 24, 1986, now abandoned.

This invention relates to an improved method of rheocasting and for producing a material which will behave thixotropically. The invention also includes an improved product for use in thixoworking, thixoforging or thixocasting processes.

A study of rheocasting and thixoworking was initiated by the observation of Spencer et al at the Massachusetts Institute of Technology in 1972 that stirring of Sn-15%Pb alloys during solidification had a marked effect on their rheological behaviour.

Partially solidified and stirred alloys possess viscosities in the range 1–100 poise, depending on the fraction solid and the stirring rate. High stirring speeds reduce the viscosity and induce thixotropic properties in the slurry, i.e. it 'gels' or stiffens when stirring ceases, but flows again on being sheared corresponding with a fall in apparent viscosity. This study led to a substantial amount of development work aimed at taking stirred metal in a highly fluid semi-solid form and casting it directly to shape in a process termed 'Rheocasting'. A further process known as 'Thixocasting' was used in which a rheocast charge is reheated after solidification for die-casting in the semi-solid state, and some attempts have been made using this process to die-cast ferrous or aluminium alloys, for example. By this method it is claimed that you obtain less shrinkage on solidification, less wear to the casting dies, and a better microstructure in the final casting. Rheocasting and thixocasting are disclosed for example in the review paper "Structures and Properties of Thixocast Steels" by K P Yound, R G Riek and M C Flemings.

An alternative method of shaping a reheated rheocast slug is to forge it in its semi-solid state between closed dies, a process termed 'Thixoforging'. It would appear to have certain clear advantages over conventional closed die forging since lower forging pressures are involved and consequently there may be savings in energy, reduction in die wear and more complex shapes may be made.

The known rheocasting processes are based upon the production, by the application of vigorous agitation during solidification, of an alloy slurry to produce solid phase particles within a liquid matrix, the mixture then exhibits thixotropic properties. The properties of the solid/liquid slurry are structure dependent (solid fraction and morphology) rather than material dependent and thus, for instance, either high speed steel or aluminium can be deformed at approximately the same stress assuming the same fraction solid and similar morphology. Even after complete solidification the material may be reheated to between its solidus and liquidus temperatures and regains the same properties.

In conventional casting processes molten metal in its superheated condition (ie at a temperature above the liquidus) is teemed into a casting or ingot mould. It is then allowed to solidify by heat conduction through the mould walls and through the shell of already solidified metal which starts to grow inwards from the mould walls. Consequently, solidification proceeds slowly and at a decreasing rate from the mould walls to the centre of the casting or ingot and generally results in a coarse and variable microstructure in terms of grain size, second phases, precipitates etc and also results in macro-segregation as a consequence of solute rejection during solidification.

By stirring or otherwise shearing the metal or alloy during solidification (i.e. in the liquidus-solidus region) dendrite arms which form at the mould walls, or at other locations in the melt, are broken into small fragments which are uniformly distributed throughout the melt by means of the stirring action. As further heat is extracted these nuclei grow into solid spherical nodules uniformly distributed throughout the remaining liquid metal. When stirring is stopped the residual liquid metal freezes and, because of solute rejection during the solidification cycle, a network of micro-segregation forms around the initially solidified spherical nodules i.e. a rheocast microstructure. On removal from the casting mould and on reheating in the liquidus-solidus range the network of micro-segregate (which has a lower melting point than the originally solidified spherical nodules) melts but the cast ingot retains its shape unless subjected to a load when it will readily flow into the shape required (i.e. it behaves thixotropically).

However, the solidification process during stirring takes a relatively long time and coarsening of the solid particles can occur resulting in a large grained microstructure. Furthermore as solidification proceeds stirring becomes increasingly difficult and there is a limit to the volume fraction of solid metal/liquid metal that can be stirred even when induction stirring is used. Furthermore, molten metals and alloys, particularly high melting point materials, are extremely difficult to stir and can be chemically and mechanically very aggressive in contact with any stirring paddles etc.

An object of the present invention is to provide an improved method of rheocasting preferably combined with thixoworking, thixocasting or thixoforging. This invention also provides an improved product for use in thixoforming processes.

According to the present invention a method of casting comprises atomisation of a stream of molten metal or metal alloy, deposition of the atomised particles of the stream onto or into a collector, and controlled extraction of heat to provide a deposit having a rheocast type microstructure which exhibits thixotropic characteristics between the solidus and liquidus phases of the metal or metal alloy.

The invention also includes a method of casting comprising the steps of atomising a stream of molten metal or metal alloy by subjecting the stream of molten metal or metal alloy to relatively cold gas directed at the stream, directing the resultant spray of metal droplets at a collector, and extracting heat the metal droplets such that after their re-coalescence on the collector surface or from the surface of the already deposited metal there exists solid phase particles in a liquid phase which, upon solidification, forms a rheocast type microstructure characterised by a fine network of microsegregate at the grain boundaries or coring across the grains and which, above the solidus region of the said metal or metal alloy, exhibits thixotropic properties. In particular the invention includes a method whereby a minimum of 10% liquid phase exists on the surface of the spray deposit.

The atomised particles are initially cooled in flight by the relatively cold atomising gas (first stage cooling). Preferably the atomising gas is an inert gas such as nitrogen, argon or helium. In most metal and metal alloys dendritic solidification of the atomised particles is initiated during flight and, on impacting the deposition surfaces, these dendrites are fragmented. The still relatively cold gas flows over the surface of the depositing particles extracting heat extremely rapidly from the surface of the spray-deposit during a second stage of cooling. By controlling the heat extraction during flight and on deposition it is possible to create a very thin film of semi-liquid/semi-solid metal on the surface of the spray deposit during its formation in which uniformly distributed solid phase metal nodules are growing in liquid phase metal.

The dendrite fragmentation which occurs on impact together with the dendrite fragmentation which occurs in the thin film of semi-liquid/semi-solid metal on the surface of the spray deposit provide an extremely large number of small dendrite nuclei uniformly interdispersed in liquid metal. These nuclei rapidly grow to form spherical nodules of solidified metal in liquid metal. The residual liquid metal solidifies after deposition by conduction of heat through the deposit (third stage cooling). This results in an extremely fine microstructure consisting of small grains of rapidly solidified metal surrounded by a fine network of micro-segregate or coring. Consequently, by accurately controlling the heat extraction a rheocast microstructure is obtained with a much finer scale than previously attainable and without the need for liquid metal stirring. This material can then be thixotropically formed at a temperature between its liquidus and solidus. Preferably the extraction of heat is controlled such that solid phase nodules are contained in residual liquid metal at the surface of the deposited metal or metal alloy, the residual liquid metal being allowed to solidify relatively slowly by heat conduction to provide a fine network of microsegregate which may be thixotropically formed between the solidus and liquidus temperatures of the metal or metal alloy. The process of thixoforming can take place either simultaneously or at some time interval after the spray deposition operation. In the case of simultaneous thixoforming and spray deposition a tool is applied under a very low load against the spray deposit during its formation. This method may not necessarily result in any significant shape change in the spray deposit but can be used solely as a method of improving the metallurgical quality of the spray deposit during its formation. For example, the application of a tool against a rotating tubular spray deposit during its formation can be used as a means of eliminating porosity in the spray deposit. The tool however could also be used to change the shape of the spray deposit durings its formation. For example, for producing roll profiles in a roll blank thixotropic deformation may be effected during spraying. This comprises the steps of forming the metal or metal alloy as a deposit of gas atomized molten metal or metal alloy droplets, maintaining or raising the temperature of the deposit above its solidus during spraying, and simultaneously applying a forming tool against the deposit to thixoform the deposit or, alternatively, allowing the deposit to drop below its solidus and reheating it above its solidus before thixoforming. In the formation of a roll blank the deposit and forming tool undergo relative rotation with the roll blank being rotated under the spray during its formation whilst at the same time being thixoformed.

This aspect of the invention also includes apparatus for thixoworking a deposit during spraying comprising a collector, means for rotating the collector about an axis of rotation, means for applying a spray of atomized metal or metal alloy against the rotatable collector, and a forming tool adjacent to the collector arranged to apply a load upon a deposit formed on the collector in a direction transverse to the axis of the collector.

Alternatively the rheocast material may be allowed to solidfy completely and may then be reheated to between solidus and liquidus so as to regain its thixotropic state. The material may then be thixotropically deformed (e.g. thixocast, thixoforged or thixoextruded) to make complete shapes or semifinished products e.g. ingots, bars, tubes, rings, plates, strips, finished articles. This can also enable working of alloys which are conventionally unworkable by ingot/wrought routes of manufacture and, for some alloys, even by powder metallurgy methods of manufacture.

By forging the deposit in its thixotropic state the amount of applied forging force is considerably reduced since the deposit will flow to shape under the application of reduced forces.

Examples of specific products that may be produced are large milling tools of 3" to 9" diameter and slot drills made from high speed tool steels, where present fabrication costs are high.

In accordance with the present invention such articles could be produced directly by thixoforging or casting between dies, to be finished possibly by machining or thixocasting. There have been attempts at casting such tools to shape, but the products have always suffered from casting defects (i.e. macrosegregation, coarse micro-structure and porosity) and are therefore unsatisfactory. The present invention provides a highly dense deposit with an improved micro-structure and no macrosegregation.

Another type of product usefully produced by the present invention are extrusion dies made from for example tool steels, die steels, or Stellites where intricate die shapes are required. The machining costs presently necessary can be a large part of the total cost of manufacture; thixoforging a die close to final shape would reduce this cost substantially.

There are also many articles of intricate shape which at present require hot working to obtain the internal soundness and mechanical properties necessary for their application e.g. forging dies, rolls for use in rolling mills, aerospace products such as turbine discs. Traditionally such articles have been made by ingot metallurgy followed by conventional hot working methods but in recent years an alternative of powder forming has been introduced. This has the advantages of decreasing the length of the production route and eliminating much of the final machinging. For some applications it has been shown to be an economically viable alternative despite the relatively high cost of powder. However, the rheocasting-thixoforming route of the present invention offers an even simpler production route (with several process stages being eliminated). For certain materials, e.g. complex stainless steels, cast superalloys etc which have relatively poor hot workability, the thixoforging route may also make possible the production of shapes that are not possible by traditional methods.

Die cast materials that exhibit a large degree of shrinkage porosity e.g. gun metal die casting, can be thixocast successfully in a 40–50% solid condition thus reducing the shrinkage by at least the same amount. In a similar way high temperature materials can have 40–50% of their latent heat removed prior to thixocasting so reducing reheating costs and die-wear.

The present invention allows spray bar, tube or other shapes to be spray deposited and cut into slugs or rings, for subsequent thixoworking into intricately shaped components. In addition semi-finished products, such as tubes, bars, strips or extruded products can also be produced where the improved micro-structure and thixotropic properties enhance production. The invention also applies to alloys which may not be worked conventionally.

The reheating of the sprayed rheocast structure to a temperature between the solidus and liquidus and thus regaining its thixotropic properties appears to be possible in most alloys, particularly those with a low melting point constituents.

The behavior of the heterogenous mixture as an apparent homogenous fluid with a 'viscosity' rather than a 'strength' is dependent on the rate of application of the stress. However, in prior methods, under the application of the deforming load, the liquid metal has tended to be squeezed out resulting in liquid/solid separation. With the much finer structure of the present invention the solid and liquid phases tend to move together except undr very slow strain rate conditions. Thus, the thixoworking or thixocasting to form the shapes disclosed above is generally effected by rapid deformation where the liquid flows and carries the solid phase particles with it.

However, for some materials, if a very slow deformation mode is employed the liquid can be squeezed out of the mixture. The squeezing of the liquid out of an ingot is known as rheofining and this property may be used in refining some scrap metals. For instance removing Sn and Cu from steel obtained from automobile scrap (1% Cu 0.5% Sn). In a similar way a subsequent process step may comprise draining the liquid phase out of the thixotropic structure under gravity alone, or by suction, pressure or centrifugal means, leaving a solid 'honeycomb'. This process could be used to produce porous metals if the alloy composition were correctly chosen. This property will provide an increased surface area useful for example in battery materials and will make the structure very much lighter, for example aluminium alloys can be reduced in weight by at least 5–10% in this way.

The present invention therefore provides an improved method of rheocasting by atomisation of molten metal and controlled extraction of heat to provide a deposit exhibiting the desired thixotropic characteristics between the solidus and liquidus phases of the sprayed material. The structure achieved in all materials is very much finer than all other previously known methods for producing rheocast materials. This finer structure in almost all cases produces a material with more desirable properties.

The invention will now be described by way of example with reference to the accompanying drawings and plates in which:

FIGS. 8, 9 and 10 are microstructures of conventional chill cast metal alloys;

FIGS. 15 and 16 show a thixoforging in accordance with the invention and the associated microstructure thereof;

Figures 17A, 17B, 18:
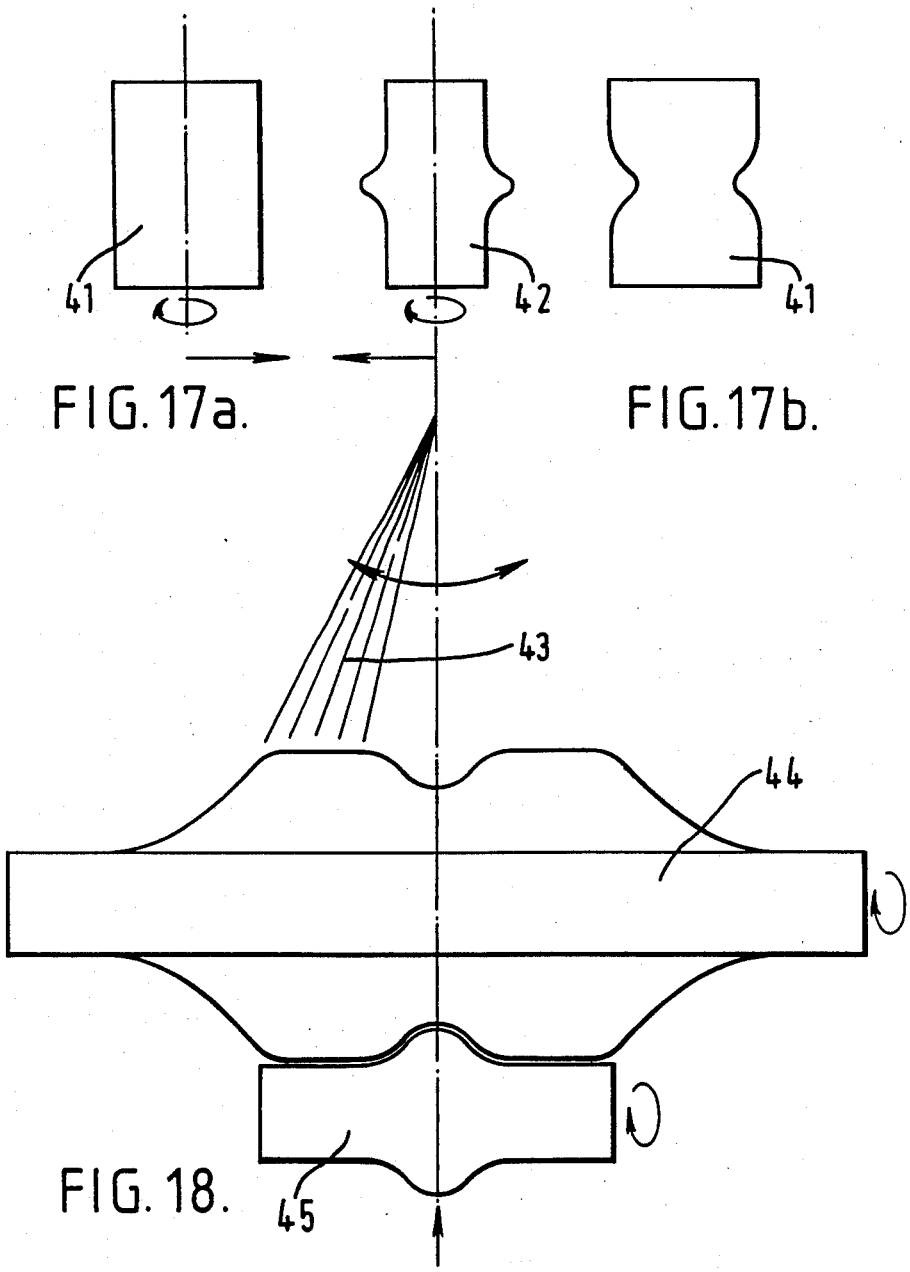

FIG. 17*a* and 17*b* illustrate diagrammatically thixoforging after spraying; and FIG. 18 illustrates diagrammatically thixoforging during spraying.

Figure 1:
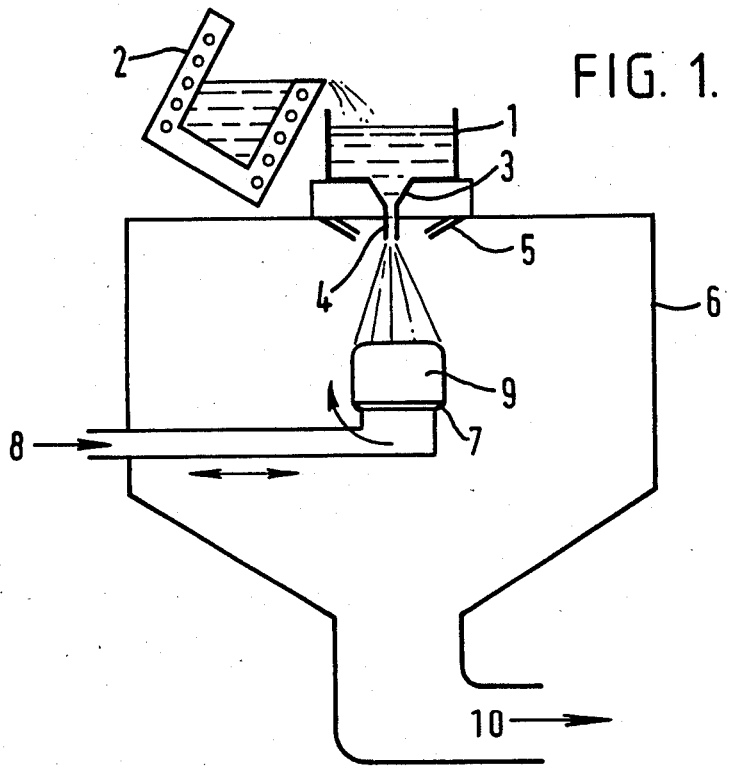
FIG. 1 is a diagrammatic side elevation of apparatus for forming a disc-shaped deposit.

In FIG. 1 of the drawings apparatus for spray deposition comprises a tundish 1 which receives metal or metal alloy from a tilting furnace 2 in which the metal or metal alloy is held above its liquidus temperature. The tundish 1 has a base aperture 3 so that molten metal may issue in a stream 4 downwardly from the tundish 1 to be converted into a spray of metal droplets by atomising gas jets 5 within a spray chamber 6; the spray chamber 6 first having been purged with inert gas so that the pick-up of oxygen is minimized. The sprayed droplets are deposited on a rotating collector 7 supported on a manipulation arm 8 so that a disc-shaped deposit 9 is formed on the collector by relative movements between the spray and the collector. The spent atomising gas passes to exhaust through exit conduit 10. The following is an example of the rheocast sample produced in apparatus in accordance with FIG. 1.

| | |
|---|---|
| Metal Alloy | Aluminium 6% silicon |
| Pour rate | 6 kg/min |
| Pour Temperature | 670° C. |
| Atomising Gas | Nitrogen gas at 115 p.s.i. |
| Gas/metal ratio | 1.2 cu. m/kg. |
| Spray distance | 420 mm |

A spray of metal droplets produced with the apparatus of FIG. 1 was directed onto a ceramic disc-shaped collector. The collector was preprogrammed to undergo rotary and reciprocal movements to produce a final deposit shape of 160 mm diameter, 100 mm tall. During flight and deposition of the metal droplets the process variables were controlled such that the metal droplets deposited at the collector included solid phase particles in a liquid phase. This deposit was allowed to solidify to form a rheocast type structure.

In order to demonstrate the thixotropic properties of the deposit so formed the following tests were conducted:

1. A chill casting of an alloy of identical composition was made to compare its solidification/remelting characteristics with that of the spray deposit of the present invention.
2. Samples cut from the chill casting and the material as-sprayed in accordance with the invention were reheated to a temperature between the solidus and liquidus temperatures of the metal alloy and the apparent viscosity of the sample was measured using a simple penetrometer of known construction accurate for comparative purposes rather than accurate absolute values.

Figure 2:
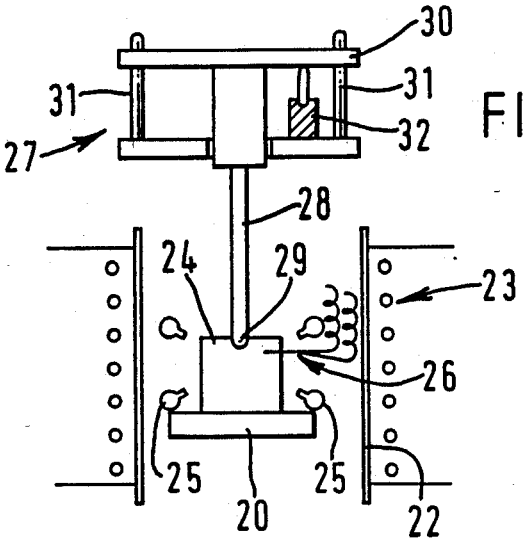
FIG. 2 is a diagrammatic side elevation of penetrometer equipment.

Such a penetrometer is shown in FIG. 2 and briefly comprises a support 20 positioned within a surrounding medium frequency induction coil (100 KW) 23 with a plastic liner 22. The coil 23 is used for heating the test sample 24 and water jets 25 are provided for quenching. A thermocouple 26 is positionable on the sample 24 to monitor the temperature of the sample 24 so that the apparatus may be operated at a predetermined temperature.

Disposed above the test sample 24 is a penetrometer 27 comprising an alumina sheath 28 having a hemispherical free end 29, a preset load 30 and guides 31. On release of the penetrometer 27 the settling velocity into the sample is measured using a carbon film linear potentiometer 32. The penetrometer relies on the relationship of viscosity of a fluid with the movement of a sphere through the fluid under an imposed load. By using an alumina sheath 28 with an approximately hemispherical tip 29 Stokes' law for terminal settling velocity can be used to estimate the viscosity of the test sample 24. The velocity of the sheath 28 falling into the sample under constant load is inversely proportional to the viscosity of the test sample 24.

3. At a predetermined temperature, measured by the thermocouple 26 inserted in the sample, the specimen was quenched with water by jets 28 to preserve as closely as possible the structure in equilibrium at the elevated temperature (i.e. between the solidus and liquidus temperature).
4. The quenched chill cast and spray cast sample were metallographically examined to estimate the quantity and distribution of the liquid and solid phases at the elevated temperature.
5. The structures were compared metallographically and the penetrometer results plotted against the measured fraction liquid.

Figure 5:
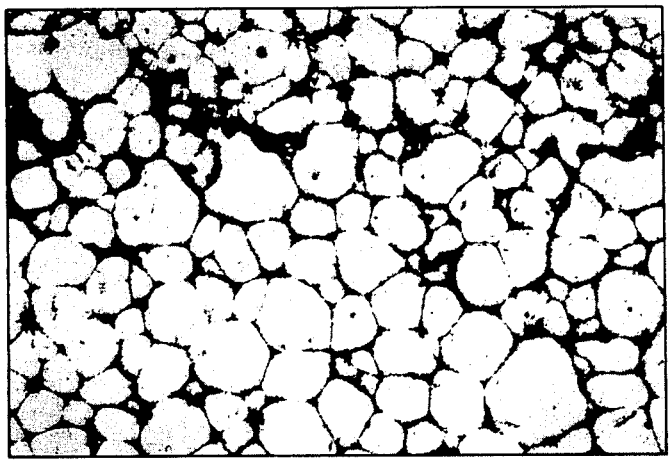
FIGS. 5, 6 and 7 are microstructures of rheocast metal alloys in accordance with the present invention.

The comparative structures can be seen from FIGS. 5, 6 and 7 and 8, 9 and 10 which are as follows: In accordance with the invention:

FIG. 5: Al/6% Si Alloy. The microstructure of sprayed material on being reheated to between the liquidus and solidus temperatures and then quenched. Grain size≃50 micron % liquid=14%. There is no evidence of conventional dentritic solidification.

Figure 6:
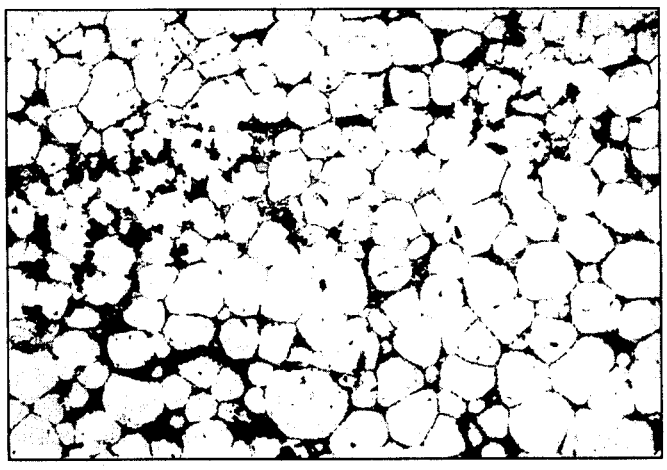

FIG. 6: Al/6% Si Alloy. As FIG. 5 but after reheating to a higher % of liquid metal. Grain size≃50 micron, % liquid=24.5%.

Figure 7:
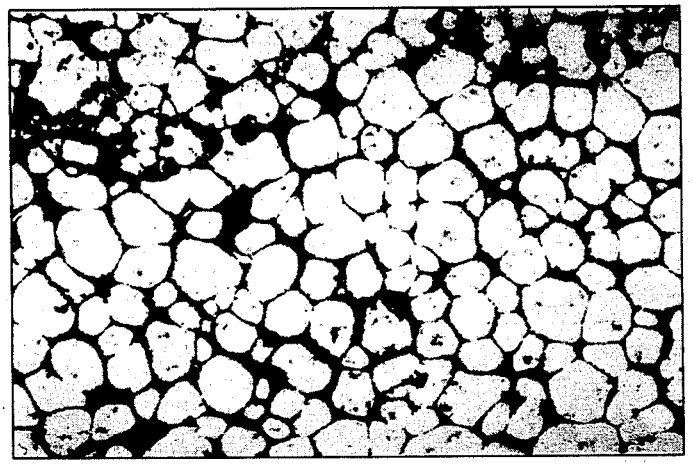

FIG. 7: Al/6% Si Alloy. As FIG. 5 but after reheating to an even higher % of liquid metal. Grain size≃50 micron % liquid=30.5%. Even at the highest level of liquid metal measured during the test the fine rheocast type microstructure was retained.

Conventional chill cast

Figure 8:
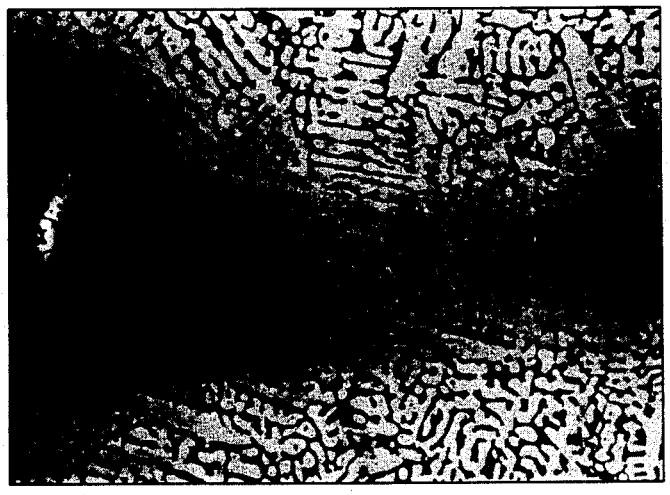

FIG. 8: Al/6% Si Alloy. The microstructure of chill cast material after reheating to between the liquidus and solidus temperatures and then water quenched. % liquid=20%. A conventional fine dentritic microstructure exhibiting a very coarse grain size is present (eg 1 mm and greater).

FIG. 9: As FIG. 8 but with 25% liquid. At this level there is considerable corsening of the microstructure.

FIG. 10: As FIG. 8 but with 40% liquid. At this level the microstructure is breaking down.

In order to achieve a reasonable comparison it should be noted that the microstructures of samples of the present invention shown in FIGS. 5, 6 and 7 are on a much larger scale than for the chill cast samples. In the samples of the present invention the fine grain size is retained—typicaly in the range 1 to 300 micron, preferably of the order of 50 micron—without the breakdown in microstructure which characterises the chill cast samples.

6. Results were also recorded obtained using the same equipment for stir cast (conventionally rheocast) samples Al/6% Si alloy. Results were also taken for spray cast M2 high speed steel. These results were plotted and are shown on the graph of FIG. 3.

Figure 3:
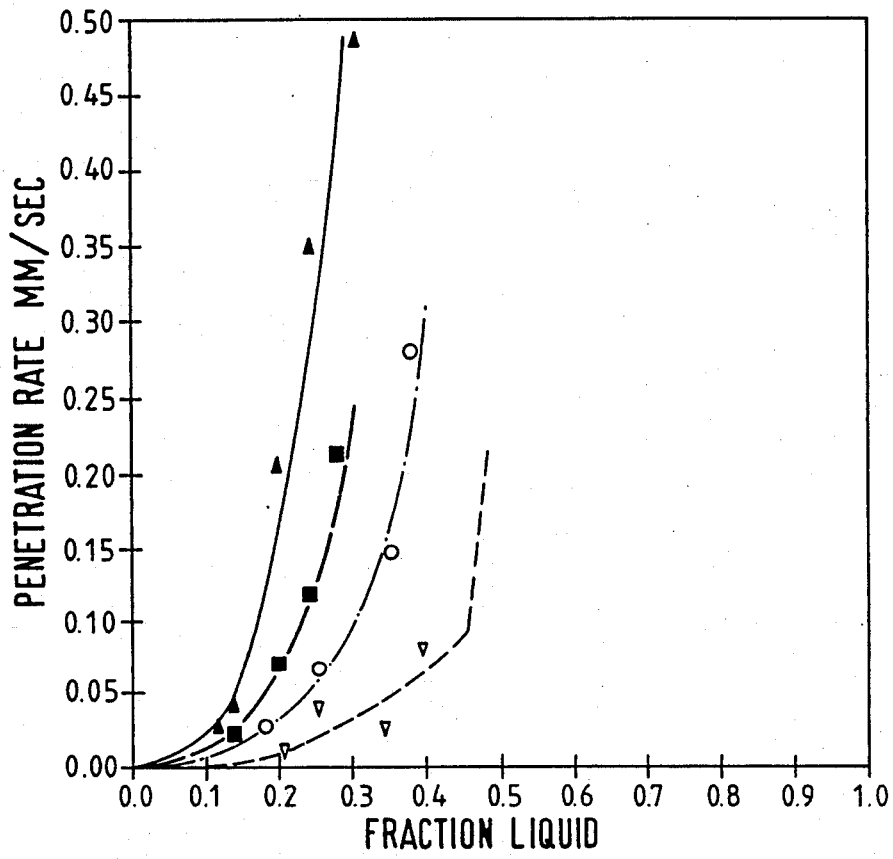
FIG. 3 is a graph of penetration results of thixotropic results of rheocast material in accordance with the present invention compared with conventional rheocast and chill cast materials.

The graph of FIG. 3 shows the relative behaviour of the different structures on reheating. The fine grain sprayed aluminium/silicon alloy softens very rapidly and behaves thixotropically at liquid fractions less than 0.3. The coarser stir cast sample softens and behaves thixotropically at higher fractions liquid and the cast material with its dendritic structure collapses at approximately 50% liquid. The sprayed M2 high speed steel behaves similarly to the sprayed Al/Si alloy. This indicates that M2 high speed steel can be thixoformed under similar conditions of stress to the Al/Si alloy. The lower fraction liquid required by the sprayed material to achieve a given viscosity compared to the stir cast material reduces the amount of liquid freezing after any thixoforming operations and hence reduces any microsegrgation and shrinkage in the thixoformed part. In addition the lower temperature for thixoforming due to the reduced liquid fraction increases die life.

7. In order to determine the thixotropic characteristic of the materials samples of the spray cast Al 6% Si and spray cast M2 high speed steel were reheated to a pre-determined condition in between the liquidus and solidus (approx 25–30% liquid) measured by the penetrometer and forged into a stepped die using the apparatus shown in FIG. 4. The thixoforging apparatus 31 in FIG. 4 comprises a die 32 and an air cylinder 33 having a piston 34. The piston 34 carries a test sample 35 for thixoforging which is raised to the desired temperature by means of a medium frequency induction heating coil 36, the temperature and condition of the sample being sensed by penetrometer apparatus simply indicated at 37. The Al/Si stir cast material produced by stirring was also reheated and forged under the same condition.

Figure 11:
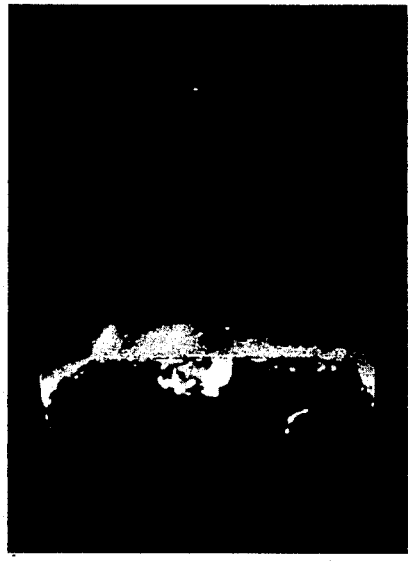
FIGS. 11 and 12 show a cross-section of a thixoforging and its associated microstructure. The thixoforging was produced from stir cast material using the apparatus of FIG. 4.
Figure 12:
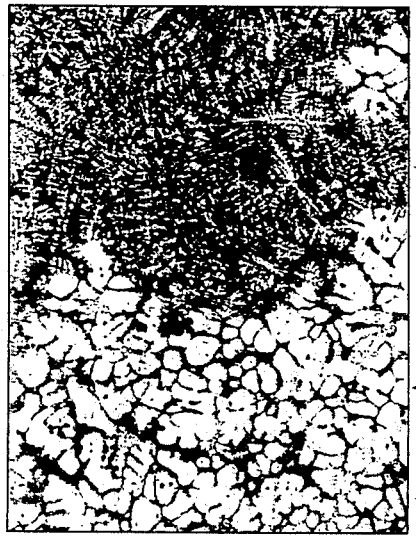
Figure 13:
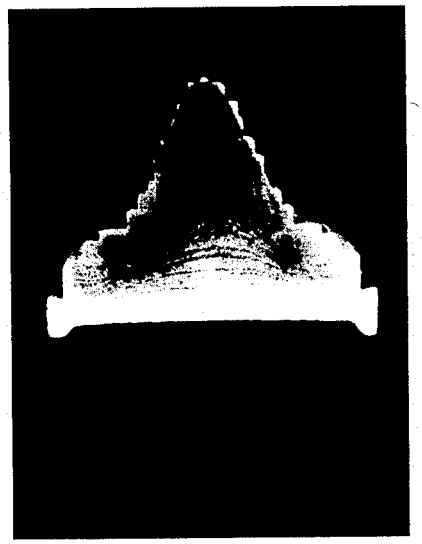
FIGS. 13 and 14 show a cross-section of a thixoforming and its associated microstructure. The thixoforging was produced using the apparatus of FIG. 4 with a material in accordance with the present invention.
Figure 14:
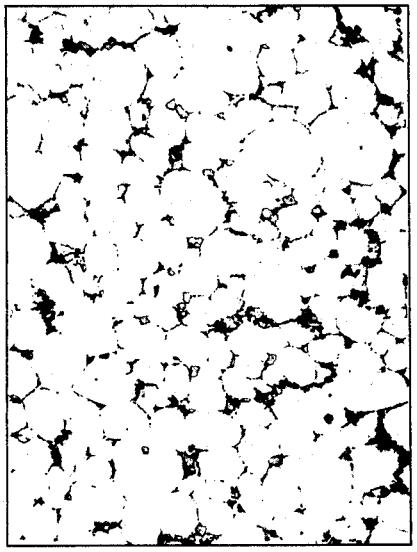

The respective thixoforgings and their microstructures are shown in FIGS. 11 and 12 (being the conventional stir cast thixoforging) and FIGS. 13 and 14 (being the spray deposited thixoforging in accordance with the invention). From FIGS. 11 and 12 it will be seen that during thixoforging of the stir cast material the liquid has been squeezed forward resulting in severe macrosegregation in microstructure. FIG. 13 shows the superior die—filling ability of the sprayed material and the microstructure in FIG. 14, shows no liquid separation. In fact the microstructure is very similar to the original as sprayed material. It is also of importance to note that the grain size of the stir cast and thixoforged material is far larger than that of the equivalent sprayed material (note that figures are at different magnifications).

Comparing the structures obtained by reheating the chill cast alloy (FIGS. 8, 9, 10) to the spray deposited alloy (FIGS. 5, 6, 7) shows that the distribution of the liquid phase is fundamentally different. The spray deposited material melts by the formation of a thin film of liquid between the nearly spherical grains. On the other hand the dendritic cast structure (from the chill casting) similarly forms a film of liquid but because the dendrites interlock they cannot slide freely against one another under external stress and tend to break along the liquid layer (commonly termed 'hot-shortness').

The progressive increase of temperature and liquid fraction does not fundamentally change the structure of the spray deposit as the liquid film merely becomes thicker as more and more of the solid grains melt. The chill cast structure, however, melts heterogeneously with large regions fully molten. This results in catastrophic reductions in compressive strength at liquid fractions higher than about 0.5–0.6.

The fall in the viscosity of any rheocast product is rapid but controllable and occurs at a lower liquid content. However, the fine grain size of the sprayed rheocast material tends to lower the viscosity at any given fraction liquid when compared to the stir cast material.

Figure 4:
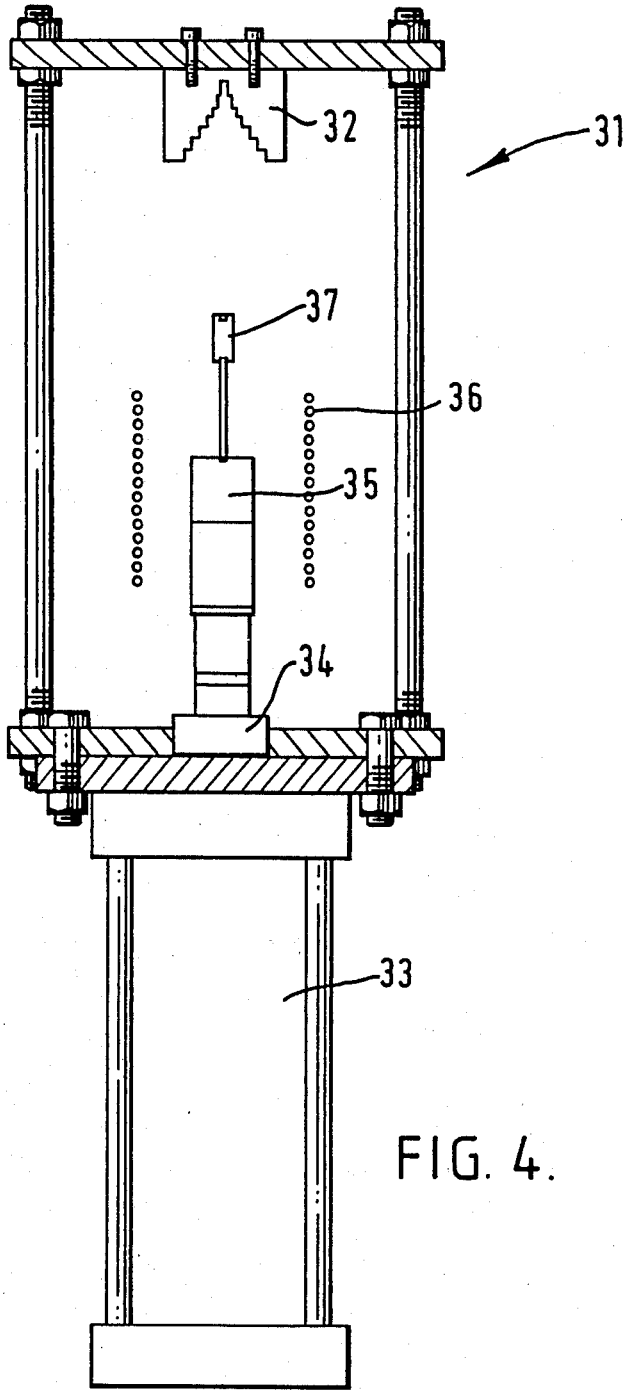
FIG. 4 is a diagrammatic side elevation of apparatus for thixoforging.

Using the equipment shown in FIG. 4, samples cut from the stir cast and spray cast ingots were heated to a temperature resulting in identical apparent viscosities. The samples were then immediately forged into a cold mild steel die. The forgings were sectioned and polished to show the microstructures (FIGS. 11, 12 and 13, 14).

It can be seen from the external shape of the forgings that the spray cast material (FIG. 13) has a superior die filling behavior. The stir cast sample shows separation of the liquid and solid with the liquid being squeezed to the top of the forging and also back past the ram to form a flash. Conversely the forging of the spray cast material is macroscopically homogeneous and indistinguishable with the sprayed samples quenched from between liquidus and solidus temperatures. Experiments with spray cast M2 high speed steel show that the response to melting is very similar to the aluminium alloy (see FIG. 3). FIGS. 15 and 16 show a M2 high speed steel slug forged into a graphite die. The forging has been effected with equipment having no atmosphere control and therefore the metal has oxidised excessively before being forged. However, between the scale the die filling ability of this material is very clear, with the machining marks of the die being clearly reproduced on the surface of the forging (FIG. 15). Moreover FIG. 16 indicates that the material did not macrosegregate (i.e. liquid and solid did not separate) and the forging retains a useful fine microstructure. The force required to forge this material was the same as used to forge the aluminium silicon alloy showing that the strength of the alloy is not material dependent.

FIGS. 17*a*, 17*b* and 18 show how thixotropic deformation may be used to make a roll profile in a roll blank. A die block could also be made using a similar technique whereby a die-forming tool would be applied to the surface of the sprayed die block held at a temperature between its liquidus and solidus to form the desired shape of cavity. In FIGS. 17*a*, 17*b* a deposit 41 is formed by atomizing a stream of molten metal or metal alloy by subjecting the stream to relatively cold gas directed at the stream and directing the spray at an appropriate collector. Heat is extracted from the molten material such that the material deposited at the collector includes solid phase particles in a liquid phase which, upon solidification, forms a rheocast type microstructure characterized by a fine network of microsegregate and which, above the solidus region of the metal or metal alloy, exhibits thixotropic properties. The deposit 41 is reheated to a temperature above its solidus and is aligned with a rotatable forming tool 42. The deposit in the form of a roll blank and a forming tool 42 are then forced together and rotated relative to one another so that the roll blank 41 is provided with the desired roll profile shown in FIG. 17*b*.

In FIG. 18 thixoforging takes place during spraying. A spray of molten metal or metal alloy droplets 43 is directed onto a rotating collector 44 and positioned adjacent the collector 44 is a rotating forming tool 45. The forming tool is applied against the deposit building up on the collector so as to form the desired surface profile when the deposit is above its solidus temperature. In this way, by applying work during spray deposition, the work required for forming the surface profile is considerably reduced as the metal or metal alloy deposit has substantially zero strength.

The use of the thixotropic properties of the spray rheocast deposit minimizes or avoids the previous expensive machining and grinding operations for forming die cavities or roll profiles. Moreover, by thixoworking a deposit during deposition whilst the deposit still contains some residual liquid metal, very high densities and improved microstructures can be obtained. This is particularly useful for ring, tube or roll shaped preforms where the spray deposit is thixoworked during spray deposition during each revolution of the rotatable collector.

We claim:

1. A method of making a thixotropic deposit on a collector comprising the steps of atomising a stream of molten metal or metal alloy by subjecting the stream of molten metal or metal alloy to relatively cold gas directed at the stream, thereby forming a spray of metal or metal alloy droplets, directing the resultant spray of droplets at the collector, modifying the spray by rapidly extracting heat at a controlled rate from the droplets in flight to form a spray predominantly comprising semi-liquid/semi-solid particles with dendritic solidification of the particles having been initiated, depositing the particles onto the collector with sufficient velocity to fragment dendrites formed during flight into dendrite nuclei, the nuclei being interdispersed in a deposit surface comprising a thin film of semi-liquid/semi-solid metal, rapidly growing the dendrite nuclei by passing the relatively cold atomising gas over the surface of the growing deposit to form substantially spherical nodules of rapidly solidified metal within a network of segregated liquid phase metal, and slowly cooling the segregated liquid by conduction to produce a network of segregated solid metal around the rapidly solidified metal modules which has a melting point less than the melting point of the nodules.

2. A method according to claim 1 comprising the subsequent step of thixoforming the spray deposit between its liquidus and solidus temperatures.

3. A method according to claim 2 wherein the spray deposit is allowed to solidfy completey and is then reheated to between its solidus and liquidus temperatures so as to regain its thixotropic state.

4. A method according to claim 2 wherein the spray deposit is thixoformed during spray deposition.

5. A method of making a thixotropic deposit comprising the steps of:

atomising a stream of molten metal or metal alloy by subjecting the stream of molten metal or metal alloy to relatively cold gas directed at the stream, directing the resultant spray of metal droplets at a collector, rapidly extracting heat from the metal droplets in flight by means of the relatively cold atomising gas to initiate dendritic solidification of the metal droplets to form semi-liquid/semi-solid particles, depositing the particles onto the collector in a condition such that the growing deposit includes a surface zone comprising solid phase fragmented dendrite nodules in a residual liquid phase, the residual liquid phase bieng sufficient such that the identity of new arriving semi-liquid/semi-solid particles is lost on deposition, rapidly extracting further heat on deposition as the relatively cold atomising gas passes over the surface of the growing deposit so as to rapidly solidify liquid metal about said nodules, and cooling the residual liquid phase about said nodules more slowly by conduction to the underlying solidified portions of the deposit whereby the deposit consists of a non-dendritic rheocast-type microstructure in which the more slowly cooled residual liquid phase consists of a fine network of microsegregate about the rapidly soldified metal nodules which is molten at a lower temperature than the rapidly solidified metal nodules so that the deposit as a whole may exhibit thixotropic properties while retaining the property of being self-supporting.

6. A method according to claim 5 comprising the subsequent step of thixoforming of the spray deposit between its liquidus and solidus temperatures.

7. A method according to claim 6 wherein the spray deposit is allowed to solidfy completely and is then reheated to between its solidus and liquidus temperatures so as to regain its thixotropic state.

8. A method according to claim 6 wherein the spray deposit is thixoformed during spray deposition.

9. A method according to claim 6 wherein the thixoforming step is carried out by thixocasting, thixoforging, thixoworking, thixorolling and thixoextruding.

10. A method according to claim 5 comprising maintaining or raising the temperature of the deposit above solidus, and applying a forming tool against the deposit to thixoform the deposit.

11. A method according to claim 10 wherein the temperature is maintained or raised during the spraying and the thixoforming is carried out during spraying.

12. A method according to claim 10 wherein the deposit is allowed to drop below its solidus and is then reheated to raise its temperature above solidus prior to thixoforming.

13. A method according to claim 10 wherein the deposit and forming tool undergo relative rotation.

* * * * *